US007608990B2

(12) United States Patent
Lin et al.

(10) Patent No.: US 7,608,990 B2
(45) Date of Patent: Oct. 27, 2009

(54) ANODE PLATE STRUCTURE FOR FLAT PANEL LIGHT SOURCE OF FIELD EMISSION

(75) Inventors: Ming-Hung Lin, Taipei (TW); Yu-Yang Chang, Tai-Nan (TW); Wei-Yi Lin, Yun-Lin Hsien (TW); Cheng-Chung Lee, Tai-Tung (TW)

(73) Assignee: Industrial Technology Research Institute, Hsinchu (TW)

( * ) Notice: Subject to any disclaimer, the term of this patent is extended or adjusted under 35 U.S.C. 154(b) by 492 days.

(21) Appl. No.: 11/357,504

(22) Filed: Feb. 17, 2006

(65) Prior Publication Data

US 2007/0035230 A1 Feb. 15, 2007

(30) Foreign Application Priority Data

Aug. 10, 2005 (TW) ..... 94127149 A

(51) Int. Cl.
*H01J 9/20* (2006.01)
*H01J 29/88* (2006.01)
*H01J 1/62* (2006.01)

(52) U.S. Cl. ..... 313/496; 313/497; 313/498; 362/612

(58) Field of Classification Search ..... 313/493–498
See application file for complete search history.

(56) References Cited

U.S. PATENT DOCUMENTS

| | | | | |
|---|---|---|---|---|
| 5,099,171 | A * | 3/1992 | Daiku et al. | 313/479 |
| 5,463,273 | A * | 10/1995 | Kato et al. | 313/461 |
| 5,608,286 | A * | 3/1997 | Levine et al. | 313/495 |
| 5,637,958 | A * | 6/1997 | Levine | 313/496 |
| 5,760,858 | A | 6/1998 | Hodson et al. | 349/61 |
| 6,426,590 | B1 | 7/2002 | Chung et al. | 313/496 |
| 6,528,944 | B1 * | 3/2003 | Kishi et al. | 313/582 |
| 6,534,916 | B1 * | 3/2003 | Ito et al. | 313/587 |
| 6,639,632 | B2 | 10/2003 | Cheng et al. | 349/12 |
| 6,653,777 | B1 * | 11/2003 | Onishi | 313/495 |

* cited by examiner

*Primary Examiner*—Sikha Roy
*Assistant Examiner*—Tracie Green

(57) ABSTRACT

This invention provides an anode plate structure for a flat panel light source of field emission. The structure for the flat panel light source includes an anode plate structure in addition to a known cathode plate structure. The anode plate structure comprises an anode plate and a fluorescent layer formed on the anode plate. The flat panel light source utilizes a cubic-bump structure of the fluorescent layer or a rough surface of the anode plate to increase the lighting areas per unit volume, thereby enhancing the lighting effect of the light source. In the embodiments of the flat panel light source, the rough surface of the anode plate may be formed with a plurality of cubic-bumps, or have a shape of plural concave lenses.

7 Claims, 4 Drawing Sheets

ANODE PLATE STRUCTURE FOR FLAT PANEL LIGHT SOURCE OF FIELD EMISSION

FIELD OF THE INVENTION

The present invention generally relates to a field emission display (FED) and more specifically to an anode plate structure for a flat panel light source of field emission.

BACKGROUND OF THE INVENTION

FIG. 1 shows a schematic view of a conventional flat panel field emission light source comprising a cathode plate module and an anode plate module. The cathode plate module mainly includes a cathode plate 101, a plurality of emitters 103, a plurality of cathode electrodes and a plurality of gate electrodes. The cathode electrodes and a plurality of gate electrodes (not shown in FIG. 1) are formed on the surface of the cathode plate 101. The anode plate module mainly includes a substrate 105, an indium tin oxide (ITO) layer 107 formed on the inner surface of the substrate 105, and a fluorescent layer 109.

Electron beams emitted from the emitters 103 at a low drive voltage, strike the fluorescent layer 109 which is on the top of the ITO layer, and trigger the light source on the fluorescent layer. Passing through the ITO layer 107, the light source is then emitted from the panel surface of the anode plate module.

The research on the lighting efficiency for flat panel field emission light sources is still on its way of evolving. To achieve the need for high luminance, a flat panel field emission light source has to increase the electron beam density as well as the voltage on the anode plate. Increasing the electron beam density degrades the lighting efficiency of the fluorescent layer. The increase of the power also results in undesirable side-effect of heat problem which makes it unsuitable to be used for a flat panel field emission light source.

SUMMARY OF THE INVENTION

The present invention has been made to overcome the aforementioned drawback of a conventional flat panel field emission light source. The primary object of the present invention is to provide an anode plate module of the flat panel light source of field emission. By providing an alternative structure for the anode plate module of the flat panel light source of field emission, or a variation of the fluorescent layer structure, the flat panel light source according to the present invention can increase the lighting area per unit for the light source, thus achieves an enhanced lighting efficiency of the light source.

In a first embodiment of the present invention, the structure for the flat panel light source of field emission includes an anode plate structure in addition to a known cathode plate structure. This anode plate structure comprises a flat anode plate, and a fluorescent layer, which is formed on the flat anode plate and has a structure of plural separated cubic-bumps thereon.

In other embodiments of the present invention, the flat panel light source of field emission includes an anode plate with a rough surface and a fluorescent layer formed on the rough surface of the anode plate. Examples of an anode plate with rough surface are a plurality of cubic-bumps, or a plurality of concave lenses.

Thereby, the spreading area of the fluorescent power on the anode plate increases, which increases the hit ratio of the electron beam on the anode plate. This thus results in much enhanced luminescent efficiency for the light source.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

As was described in the previous section, the structure of the flat panel light source of field emission according to the present invention includes an anode plate structure in addition to a known cathode plate structure. The known cathode plate structure comprises a cathode plate, plural cathode electrodes and plural gate electrodes formed on the cathode plate, and a plurality of emitters.

The anode plate structure of the present invention comprises an anode plate and a fluorescent layer formed on the surface of the anode plate. The anode plate includes a substrate and a reflection layer (not illustrated in the following FIGS.) formed on the substrate. The anode plate structure according to the present invention is featured by the surface structure of the anode plate. The features include the surface structure design for the fluorescent layer as well as the surface structure design for the anode plate. The detail of the features will be described in the following embodiments of the present invention.

Figure 1:
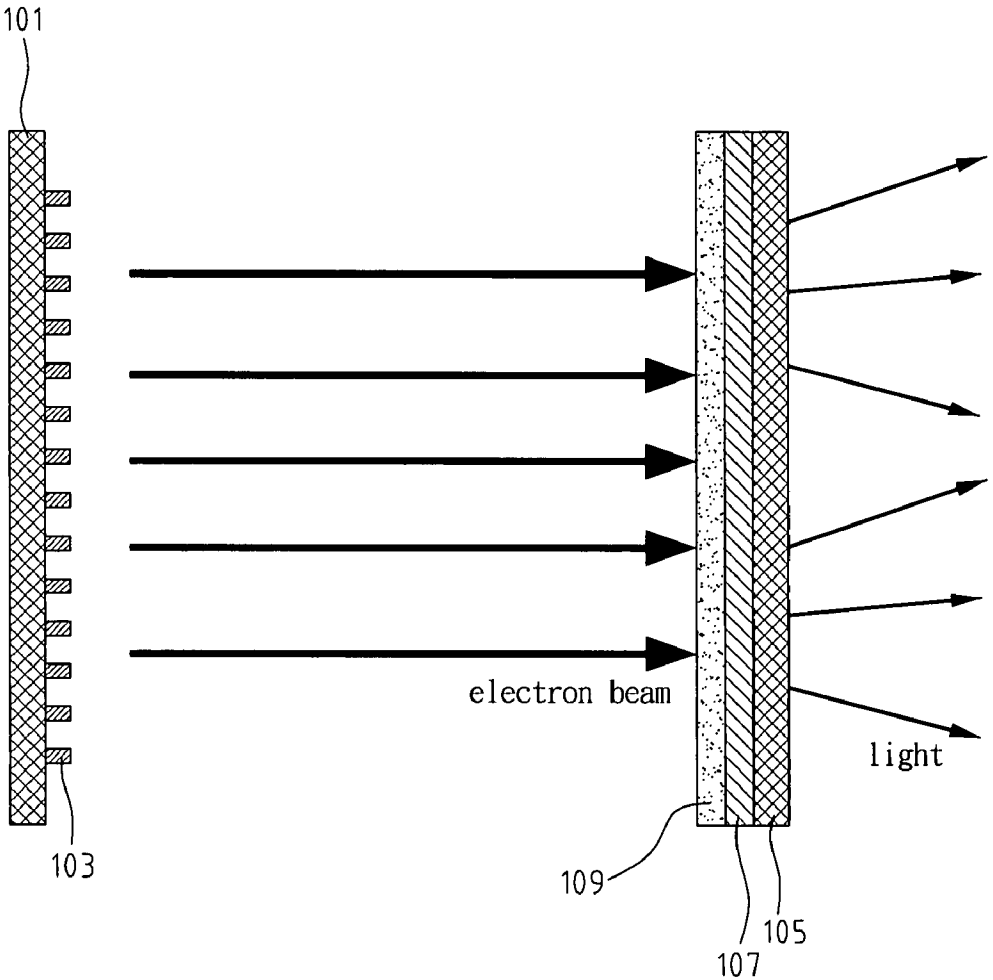
FIG. 1 (Prior Art)
FIG. 1 shows a schematic view of a conventional flat panel field emission display.
Figure 2:
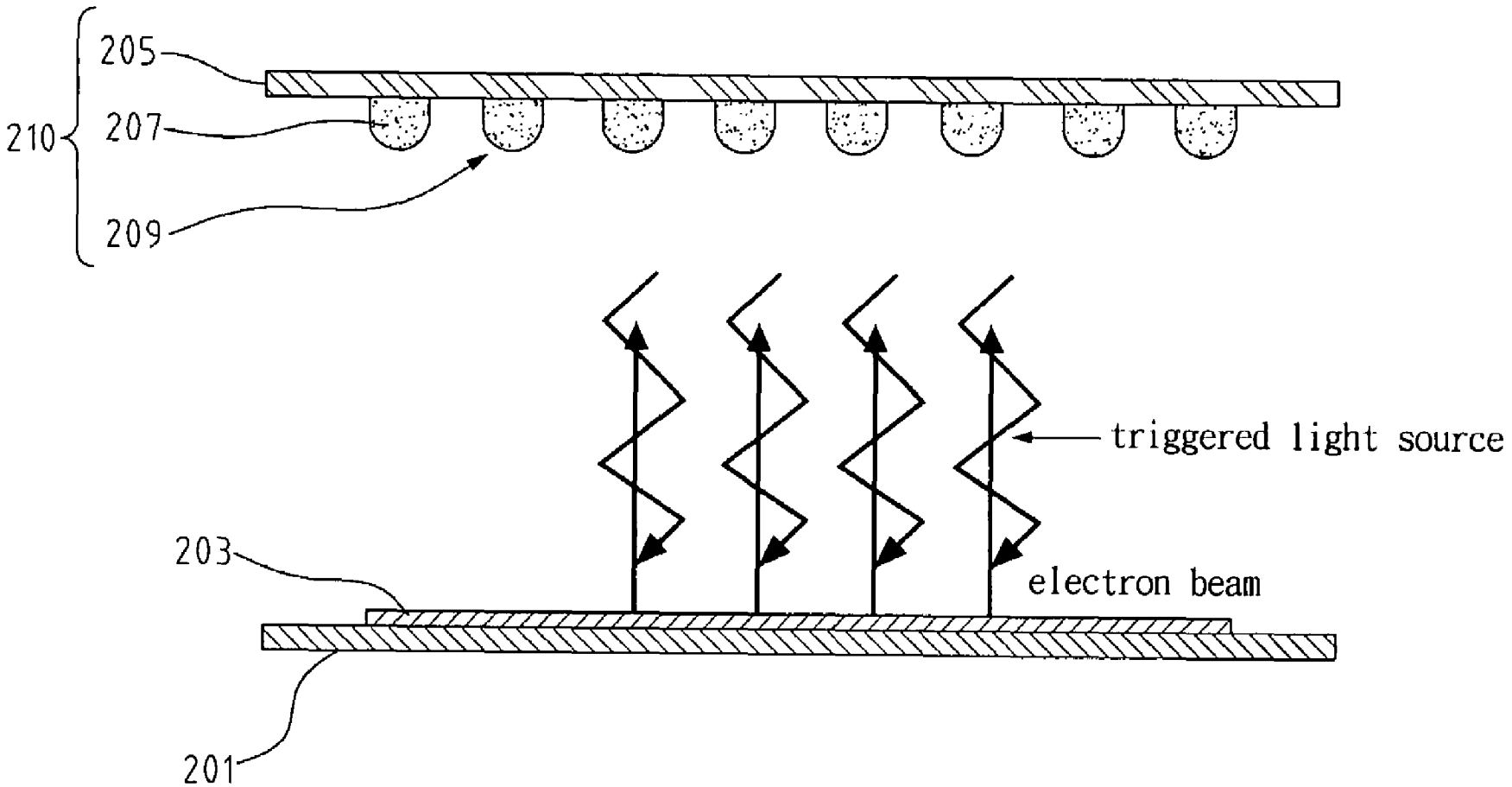
FIG. 2 shows a schematic view of a first embodiment of the present invention.
Figure 3:
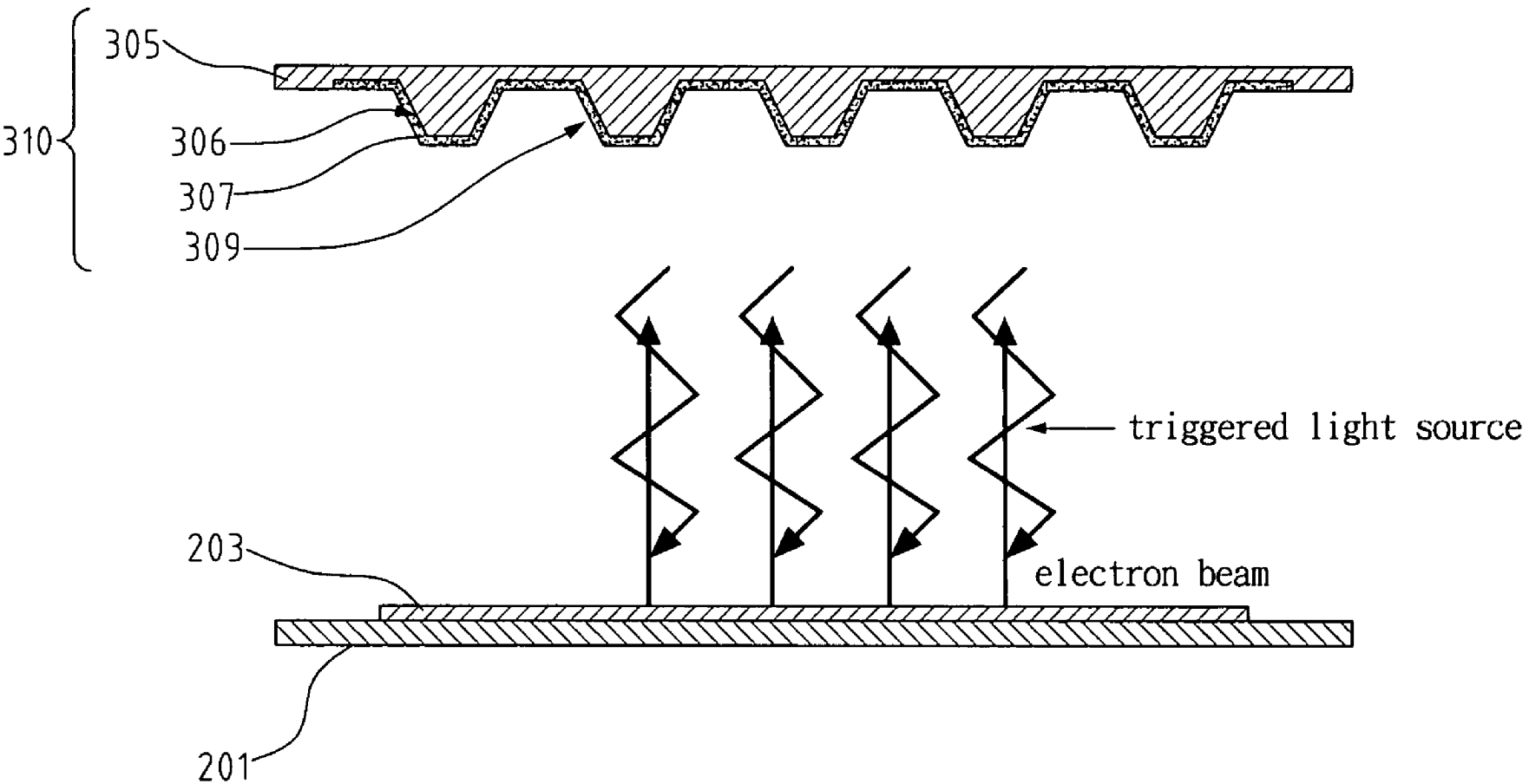
FIG. 3 shows a schematic view of a second embodiment of the present invention.
Figure 4:
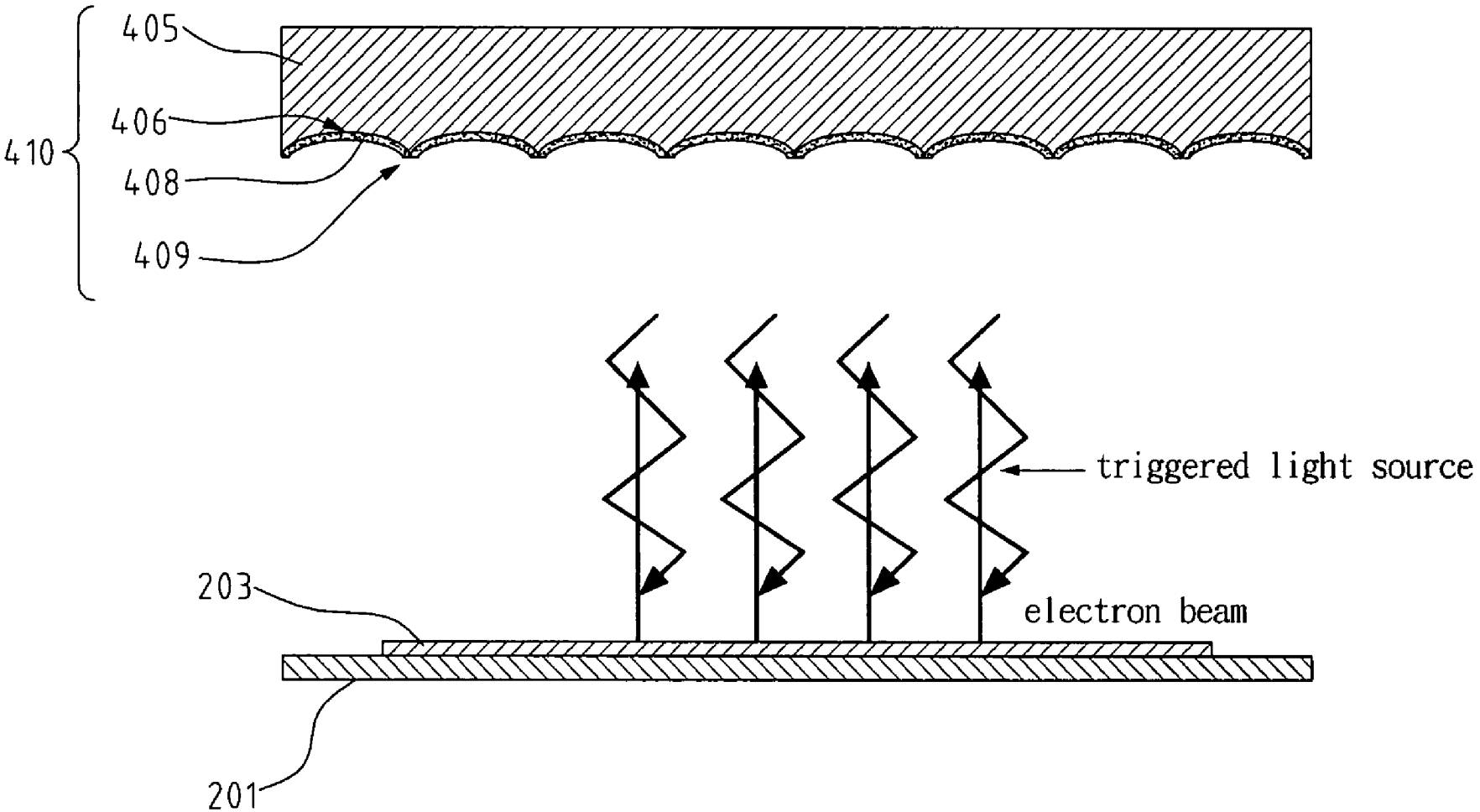
FIG. 4 shows the schematic view of a third embodiment of the present invention.

FIG. 2 to FIG. 4 illustrate the structures for the first embodiment to the third embodiment, respectively.

Referring to FIG. 2, in the first embodiment, the known cathode plate structure includes a cathode plate 201, plural cathode electrodes and gate electrodes formed on the cathode plate 201, and a plurality of emitters 203. The anode plate structure includes a flat anode plate 205, and a fluorescent layer 209 having a plurality of separated cubic-bumps 207 thereon.

The fluorescent layer 209 with plural cubic-bumps can be formed by coating the surface of the flat anode plate with the fluorescent paste via a screen printing method.

In the following second embodiment and the third embodiment of the present invention, the cathode plate structure is identical to that of the first embodiment. For the anode plate structure, the anode plate of the second and the third embodiments comprises a rough surface structure.

Referring to FIG. 3, in this second embodiment, the anode plate structure 310 comprises an anode plate 305 with a rough surface 306, and a fluorescent layer 309 formed on the rough surface 306. The anode plate 305 comprises a cubic concave-convex structure 307. The fluorescent layer 309 is formed on the surface of this cubic concave-convex structure 307. The cubic concave-convex structure 307 can be formed on a flat substrate with a plurality of convex cubic-bumps. The rough surface structure 306 of the anode plate 305 can be also formed by varieties of methods like etching or sand spray.

Compared with the surface area of the anode plate in the first embodiment, the cubic concave-convex structure 307 of the rough surface 306 in the second embodiment has larger surface area for the coating of fluorescent paste. With the increased hit ratio of the electron beam under the same condition of electron density and anode plate voltage, the resulting luminescent efficiency can thus be much enhanced for the light source.

Referring to FIG. 4, the difference in this third embodiment from the second embodiment of the present invention is in its design for the anode plate structure 410. The rough surface 406 of the anode plate 405 for the anode plate structure 401 is formed by a structure with a shape of plural concave lenses 408. The fluorescent layer 409 is formed on the rough surface 406.

The rough surface 406 formed by the structure with a shape of concave lenses increases the direction of the triggered emitters and thus enhances the light gathering effect of the light source.

In conclusion, the present invention utilizes the surface structure of the anode plate including a variation of the fluorescent layer structure and a variation of the rough surface of the flat anode plate to increase the surface area for the fluorescent paste coating, thereby increasing the hit ratio of electron beam. This enhances the luminescent efficiency of the light source. By increasing the direction of the triggered emitters, the rough surface with a shape of concave lenses also enhances the light focusing effect of the flat panel light source of field emission.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An anode plate structure for a flat panel light source of field emission, said anode plate structure comprising:

a flat anode plate having flat surfaces on both sides; and a fluorescent layer formed on said flat anode plate, said fluorescent layer forming a plurality of separated cubic-bumps on the flat surface of said flat anode plate.

2. The anode plate structure for a flat panel light source of field emission as claimed in claim 1, wherein said flat anode plate comprises at least a substrate, and a reflection layer formed on said substrate.

3. The anode plate structure for a flat panel light source of field emission as claimed in claim 1, wherein said fluorescent layer with said cubic-bumps is formed by coating the surface of said flat anode plate with a fluorescent paste via a screen printing.

4. An anode plate structure for a flat panel light source of field emission, said anode plate structure comprising:

an anode plate having a rough surface formed in a shape of a plurality of cubic concave lenses for enhancing light gathering effect of said flat panel light source; and a fluorescent layer formed on said rough surface;

wherein said plurality of cubic concave lenses faces a cathode plate of said flat panel light source.

5. The anode plate structure for a flat panel light source of field emission as claimed in claim 4, wherein said flat anode plate comprises at least a substrate, and a reflection layer formed on said substrate.

6. The anode plate structure for a flat panel light source of field emission as claimed in claim 4, wherein said rough surface of said anode plate is formed by an etching process.

7. The anode plate structure for a flat panel light source of field emission as claimed in claim 4, wherein said rough surface of said anode plate is formed by a sand spray process.

* * * * *